US010636289B2

(12) United States Patent
Kitazawa

(10) Patent No.: US 10,636,289 B2
(45) Date of Patent: Apr. 28, 2020

(54) RADIO CONTROL TRANSMITTER

(71) Applicant: Futaba Corporation, Mobara-shi (JP)

(72) Inventor: Hideo Kitazawa, Mobara (JP)

(73) Assignee: Futaba Corporation, Mobara-Shi, Chiba (JP)

( * ) Notice: Subject to any disclaimer, the term of this patent is extended or adjusted under 35 U.S.C. 154(b) by 0 days.

(21) Appl. No.: 16/260,710

(22) Filed: Jan. 29, 2019

(65) Prior Publication Data

US 2019/0236934 A1 Aug. 1, 2019

(30) Foreign Application Priority Data

Jan. 30, 2018 (JP) ..... 2018-013573

(51) Int. Cl.
*G08C 17/02* (2006.01)

(52) U.S. Cl.
CPC ..... *G08C 17/02* (2013.01); *G08C 2201/30* (2013.01)

(58) Field of Classification Search
None
See application file for complete search history.

(56) References Cited

U.S. PATENT DOCUMENTS 9,004,977 B2 * 4/2015 DeWitt ..... A63H 30/04 446/175
2012/0286941 A1 11/2012 Yamamoto et al.

FOREIGN PATENT DOCUMENTS

JP 2012-232069 11/2012

* cited by examiner

*Primary Examiner* — K. Wong
(74) *Attorney, Agent, or Firm* — Quarles & Brady LLP

(57) ABSTRACT

A switch mechanism arranged on a slanted inner peripheral face of a recessed portion formed on a back side of a housing and capable of providing good click feeling is provided. The rotatably-arranged switch mechanism is provided on the slanted inner peripheral face of the recessed portion formed on the back case on back side of a display part, and includes a push part arranged on one end of a knob body arranged rotatable around a shaft to be pushed by a user's finger, and a transmission part located at another end of the knob body to transmit rotation force generated by pushing the push part to a push switch. When the push part is pushed by the finger during control, the knob body rotates around the shaft and transmits rotational force to an actuation piece of the push switch via the transmission part, thereby pushing the push switch.

2 Claims, 5 Drawing Sheets

〈CONFIGURATION OF A CONVENTIONAL PUSH SWITCH〉

〈ILLUSTRATIVE CONFIGURATION IF PUSH SWITCH IS APPLIED TO A SLANTED FACE〉

RADIO CONTROL TRANSMITTER

CROSS-REFERENCE TO RELATED APPLICATION

The priority application Japanese Patent Application No. 2018-013573 upon which this patent application is based is hereby incorporated by reference.

FIELD OF THE INVENTION

The present invention relates to a radio control transmitter for remote controlling an object to be controlled via wireless communication, the object to be controlled including, for example, various models (e.g., automobiles, motorcycles, aircrafts, ships or the like) and industrial machines such as cranes.

BACKGROUND

Radio control transmitters for remote controlling, via wireless communication, objects to be controlled such as various models (e.g., automobiles, motorcycles, aircrafts, ships) and industrial machines such as cranes, may have various shapes depending on the type of the object to be controlled.

The radio control transmitters of this kind can be divided into two types, a trigger type and a stick type, according to their shapes. The radio control transmitter of the trigger type includes a trigger for operating a throttle of an engine or a motor and a wheel for controlling steering of the object to be controlled, and is used mainly for operating a model automobile. The radio control transmitter of the stick type includes two sticks to be operated in an up-down direction and a right-left direction provided on a housing so as to be aligned with respect to each other in the right-left direction. The radio control transmitter of the stick type is used for controlling the object to be controlled such as a model automobile, a model aircraft, a model helicopter, a model ship and an industrial machine.

As disclosed in JP 2012-232069A, the radio control transmitters in recent years include a display provided on a front case for displaying various setting screens (such as setting screens for assigning functions of setting keys, and setting screens for adjusting an accelerator and a brake), and for displaying information of the object to be controlled or of usage environment to provide various information during the operation.

SUMMARY OF THE INVENTION

However, the stick type radio control transmitter with the display arranged at a lower portion of the front case as disclosed in JP 2012-232069A has a drawback that, when a user checks the display contents during the control, the user needs to move his/her sight line for a long distance from the object to be controlled to the display, making it difficult for the user who is inexperienced in operating to check the display contents during the control.

In addition, there are demands from the users for the control device with an increased display area of the display. However, in the case of the above-mentioned configuration in which the display is arranged at the lower portion of the front case, there is a limitation on increasing the display area of the display since other components such as various setting keys are also arranged around the display.

The inventors in the present application had launched a development of a transmitter having a display arranged at a substantially central, upper portion of a front case, so as not to be restricted by sticks and various operation keys having fixed arrangement location. However, during the development, the inventors had confronted a new problem associated with the change in the arrangement of the display. That is, in addition to the display, if the control board is also arranged at the upper portion of the transmitter (i.e., on a back face of the display) as in the conventional transmitter, then a center of gravity of the transmitter would be shifted and biased toward the upper portion, causing unbalance in weight during the operation. As a result, controllability is lowered.

As results of the earnest study, the inventors in the present application had found that this biased arrangement of the center of gravity can be prevented and the above-described problem can be solved by forming a recessed portion so as to reduce the thickness of the back face of the display and by moving the control board (i.e., a main board) to the lower portion of the transmitter. As a result, the visibility of the display can be improved, while reducing the weight of the upper portion of the transmitter and providing balance in weight that is similar to the conventional transmitter. In addition, since an inner peripheral face of the recessed portion formed on the back side of the display is slanted so as to extend outward such that a user can easily grip and hold the transmitter, grippability has improved compared to the conventional transmitter.

Meanwhile, in the development of a new transmitter, the inventors in the present application had noticed that, when a user holds a prototype transmitter with both hands, his/her finger comes in contact with a portion of the inner peripheral face of the recessed portion. Then, the inventors had considered whether it is possible to provide a switch that can be operated without moving the sight line during the control, at this region of the inner peripheral face that can be reached by the user's finger.

Regarding a switch mechanism, FIG. 5 shows a structure of a commonly used switch mechanism. This switch mechanism is provided with a switch knob that is located opposite to an actuation piece of a push switch arranged on the control board. The actuation piece is moved by pushing the switch knob downward in a vertical direction in the drawing, thereby operating the switch with a good click feeling.

However, when the display is arranged at the upper portion of the transmitter to improve the visibility of the display, the control board needs to be moved to the lower portion to provide balance in weight of the transmitter, causing the switch knob and the push switch to be positioned distant from each other. Thus, there is a problem that a good click feeling cannot be obtained.

Further, the conventional switch mechanism does not operate properly if the actuation piece of the push switch is not pushed downward in the vertical direction (i.e., the up-down direction in the drawing) by the switch knob, as shown in FIG. 5. Thus, if the switch is provided at a location corresponding to the slanted inner peripheral face of the recessed portion, then the pushing direction will be limited, causing a problem that the switch cannot be operated in a reliable manner during the operation of the transmitter.

An object of the invention is to provide a radio control transmitter including a switch mechanism that is provided at a slanted face of a recessed portion formed on a back side of a housing of the radio control transmitter and that can be operated with a good click feeling during control of the radio control transmitter.

To achieve the above-mentioned object, one embodiment of the present invention provides a radio control transmitter configured to control an object to be controlled, including a housing and a switch mechanism, wherein the housing includes a recessed portion formed on a back side of the housing, the recessed portion having a bottom face and an inner peripheral face, the inner peripheral face being slanted so as to gradually extend outward from the bottom face, wherein the switch mechanism is provided to the inner peripheral face of the recessed portion, wherein the switch mechanism includes a switch knob and a push switch, the switch knob including a knob body supported inside the housing in a manner rotatable around a shaft, a push part provided on a first end of the knob body so as to be exposed from the inner peripheral face, and a transmission part provided on a second end of the knob body and configured to transmit rotation force of the knob body rotated by pushing force generated by pushing the push part, the push switch being mounted on a switch board arranged on the back side of the housing and being configured to be operated by the rotation force that is generated by rotation action of the switch knob and that is transmitted to the push switch via the transmission part.

Another embodiment of the present invention provides the radio control transmitter described above further including a display part provided at a substantially central portion of a front side of the housing, with an upper end of the display part being protruded from an upper portion of the housing, wherein the recessed portion is formed on the back side of the housing at a location opposed to the display part.

According to the present invention, by providing the switch mechanism at the slanted inner peripheral face of the recessed portion formed on the back side of the housing, weight of the upper portion of the housing can be reduced, and also it is possible to make good use of the inner peripheral face of the formed recessed portion. Further, in the switch mechanism arranged at the inner peripheral face of the recessed portion, the knob body can be rotated only by the user sliding his/her finger along the inner peripheral face and pushing the push part during the control. Then, the rotation force associated with this rotation action of the knob body is transmitted through the transmission part and operates the push switch located on the sub board arranged on the housing back side. Consequently, the operation of the switch can be performed with a definite click feeling.

DETAILED DESCRIPTION OF EXEMPLARY EMBODIMENTS

Figure 1:
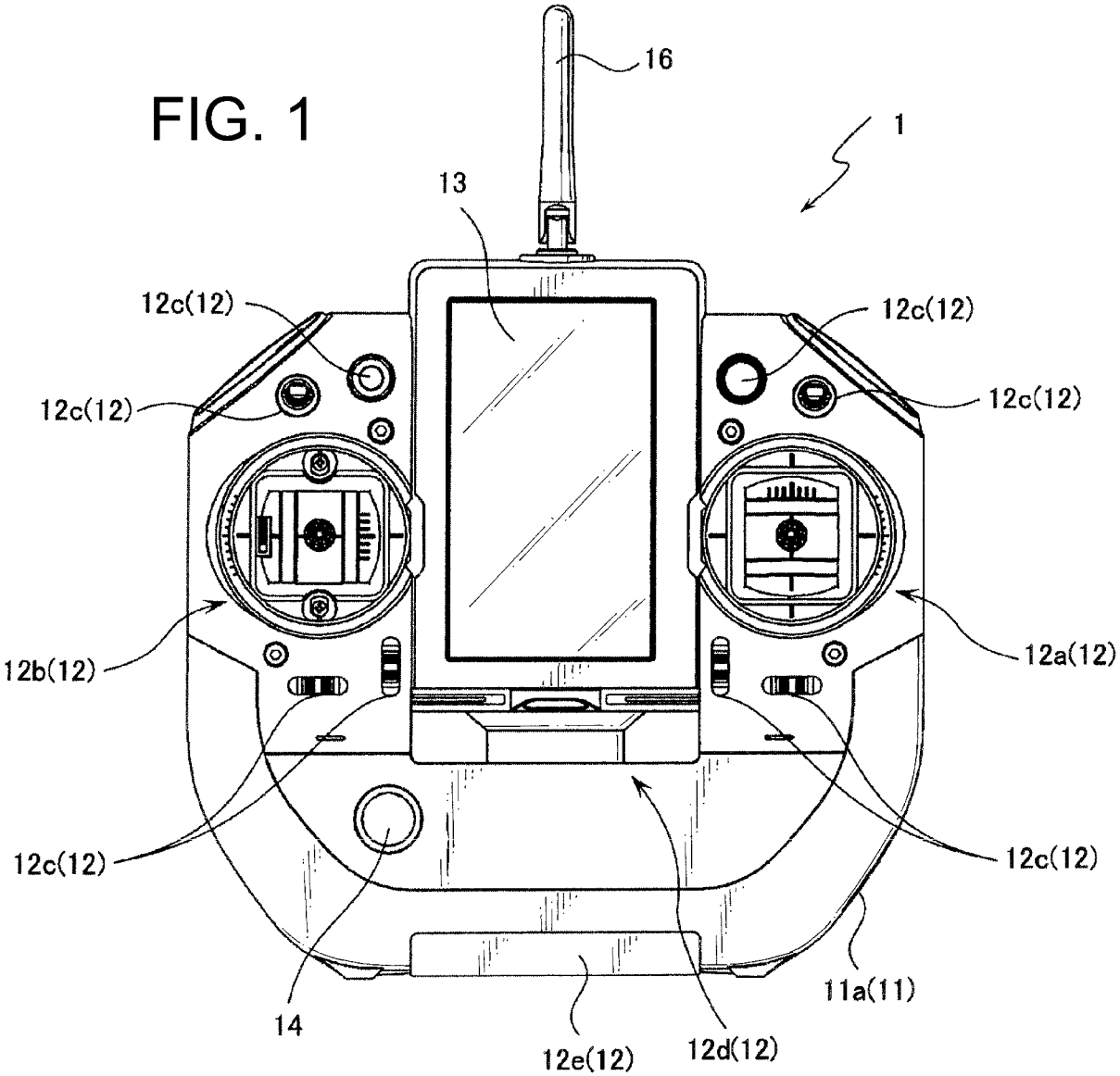
FIG. 1 is a front view of a radio control transmitter according to an embodiment of the present invention.

The following will explain an exemplary embodiment of the present invention in reference to the drawings.

In the drawings, scale, aspect ratio, shape and the like may be changed from those of an actual article, and they are only schematically shown for the purpose of convenience in illustrating and in providing a better understanding. That is, the drawings are illustrative only and are not intended to limit the interpretation of the present invention. Therefore, the present invention should not be limited by embodiments illustrated using the drawings, and other embodiments, modified examples and application technologies and such that can be derived by a person skilled in the art based on the embodiments described herein should all fall within the scope of the present invention.

Further, terms indicating direction or location such as "up", "down", "right" and "left" used in the following description with reference to the respective drawings correspond to up, down, right and left, respectively, when a user sees the respective drawings in a manner as shown.

A radio control transmitter (hereinafter referred to as "transmitter") according to the present invention is configured to remote-control an object to be controlled, the object to be controlled may include various models (e.g., automobiles, motorcycles, aircrafts, ships and the like) and industrial machines like cranes. The transmitter uses a predetermined frequency band (2.4 GHz band, for example), determines a transmission frequency using a frequency hopping method including automatically selecting an empty band from the transmission frequency band, transmits to the object to be controlled a control signal (radio wave) according to the operation of an operation member such as a stick provided on a housing, thereby remote-controlling the object to be controlled.

Configuration of Transmitter

Firstly, configuration of a radio control transmitter (hereinafter referred to as "transmitter") 1 according to this embodiment will be explained in reference to FIG. 1 and FIG. 2. Although in the following description respective functions are explained with respect to a transmitter that controls an automobile as an object to be controlled, the object to be controlled may include models other than automobiles such as motorcycles, aircrafts, ships and the like and industrial machines like cranes, as described above. Therefore, various functions to be assigned to a later-described operation part 12 and a setting part 14 may be set appropriately so as to correspond to devices selected as the object to be controlled.

Figure 2:
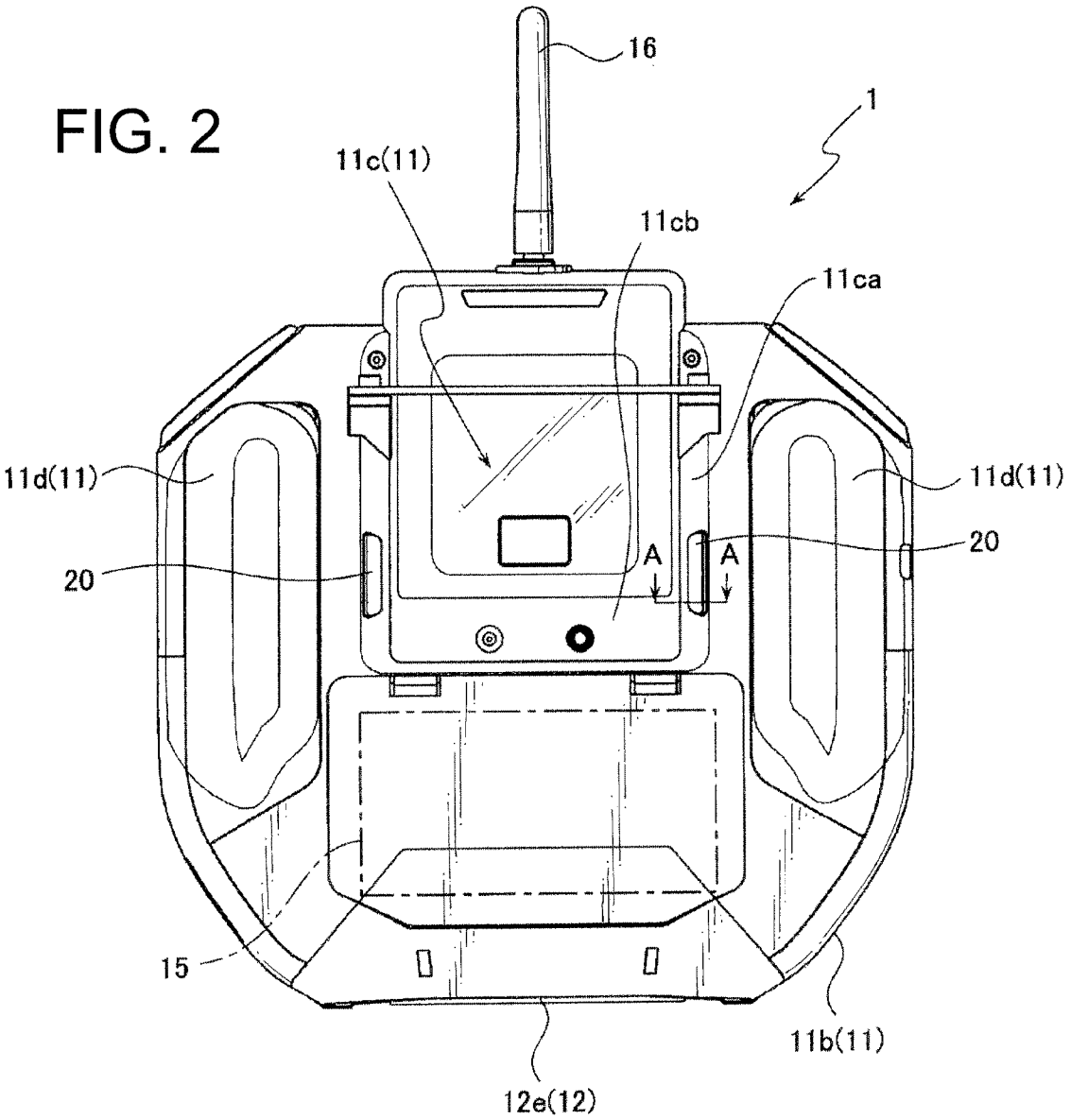
FIG. 2 is a back view of the radio control transmitter according to the embodiment of the present invention.

As shown in FIG. 1 and FIG. 2, the transmitter 1 includes a housing 11, the operation part 12, a display part 13, the setting part 14, a power supply part 15 and an antenna 16.

The housing 11 is constituted of a front case 11*a* and a back case 11*b*. The front case 11*a* and the back case 11*b* are butted onto each other and screwed together with a control board (not shown) as a main board embedded at a lower portion of the housing 11, thereby the transmitter 1 is assembled.

The control board is an electronic circuit board in which electronic components such as a CPU, ROM, RAM and the like, for example, are mounted on a printed board. The control board performs electrical processes of the respective parts constituting the transmitter 1. The processes may include, for example, production of transmission data according to the operation of the operation part 12, modulation and amplification processes for converting the transmission data to control signal, display control of the display part 13, storing of various setting contents of the setting part 14 and control programs of the respective parts, power supply control of the power supply part 15, output control of the control signal and reception control of telemetry data from the object to be controlled via the antenna 16, and processes in accordance with switch operation of a later-described switch mechanism 20.

The control board is connected to a later-described switch board 23 via a lead wire, and is configured to perform control based on the switch operation of the switch mechanism 20.

A recessed portion 11*c* for reducing the weight of the back case 11*b* is formed on a region of the back case 11*b* corresponding to the back side of the display part 13.

This recessed portion 11*c* is formed such that, when viewed from the back side, an inner peripheral face 11*ca* that corresponds to a rising portion of the recessed portion 11*c* is slanted at a predetermined angle (obtuse angle) so as to gradually extend outward from a bottom face 11*cb*. Thus, when the user holds grip parts 11*d* that are provided on both sides of the back case 11*b* with both hands, his/her fingertip or finger pulp abuts on a portion of this slanted inner peripheral face 11*ca*. Consequently, the user can hold the transmitter more firmly compared to the conventional transmitter.

In this embodiment, the recessed portion 11*c* is formed into a two-step recessed shape, that is, a substantially central portion of the bottom face 11*cb* is further recessed as shown in FIG. 2. However, this further recessed portion may not be required, and thus the recessed portion 11*c* may be formed into a single-step recessed shape. That is, regarding the shape of the recessed portion 11*c*, as long as the recessed portion 11*c* has at least the inner peripheral face 11*ca* that is slanted so as to gradually extend outward from the bottom face 11*cb*, the bottom face 11*cb* may take the form of any shape.

In the present invention, to effectively use this inner peripheral face 11*ca* of the recessed portion 11*c*, the later-described switch mechanism 20 is provided at a location on the inner peripheral face 11*ca* where the switch mechanism 20 can be pushed downward by the user's fingertip or finger pulp. The configuration of this switch mechanism 20 will be described later in more detail.

The operation part 12 includes sticks 12*a*, 12*b* arranged on the right and left sides of the display part 12, respectively, such that one stick 12*a* is arranged on each side, as shown in FIG. 1.

One of the sticks 12*a* (i.e., a member on the right side in FIG. 1) may serve as a steering to control a travelling direction of the object to be controlled (i.e., the automobile), and can be operated in the right and left directions in the drawing. Another one of the sticks 12*b* (i.e., a member of the left side in FIG. 1) may serve as a throttle to control travelling speed of the object to be controlled (i.e., the automobile), and can be operated in the up and down directions in the drawing. It should be noted that the positions of the sticks 12*a*, 12*b* may be inverted in the right-left direction.

Furthermore, the front case 11*a* is provided with a plurality of setting changing operation members 12*c* which may include a toggle switch, a slide switch, a dial and the like. In a default state, these setting changing operation members 12 are pre-assigned with functions associated with the operations. However, the setting part 14 may be used to change the settings so as to assign functions desired by the user (e.g., when the object to be controlled is an automobile, the function may include on/off of a turbo function, mixing, gyro-operation, lap time measurement, sudden braking, or camera function) to the setting changing operation members 12.

Further, a power-supply switch 12*d* for turning on and off the display part 13 or turning on and off the power supply of the transmitter 1, is provided below the display part 13 on the front case 11*a*.

Further, a press switch 12*e* is provided at a lower end of the front case 11*a*. The press switch 12*e* is configured to be operated, i.e., turned on and off, during the remote-control of the object to be controlled by means other than the user's hands (for example, a body part such as chest, stomach, shoulder, leg, knee, or a surrounding object such as a balustrade of stadium), since both hands of the user are to be used for the operation of the sticks 12*a*, 12*b*.

This press switch 12*e* is configured such that, when the user presses the press switch 12*e* with his/her body part or with the surrounding object while his/her both hands are full during the remote-control of the object to be controlled, this pressing turns on the switch, thereby performing the assigned function (e.g., when the object to be controlled is an automobile, the function may include on/off of a turbo function, mixing, gyro-operation, lap time measurement, sudden braking, or camera function).

As described above, the operation part 12 is constituted of the sticks 12*a*, 12*b* that are operated during the control of the object to be controlled, the setting changing operation members 12*c*, the power supply switch 12*d* and the press switch 12*e*.

The display part 13 is constituted of a display device such as a LCD (liquid crystal display) and an OLED (organic light-emitting diode). In this embodiment, in order to make a display area of the display part 13 to be greater than that of the conventional device, the display part 13 is arranged at a substantially central portion of the housing 11 in a vertically long fashion, with the display part 13 being shaped such that its top portion protrudes more than a top portion of the housing 11. With this arrangement, the display area of the display part 13 is increased, and also the visibility of the display part 13 is improved since the display area is moved from the lower portion to an upper portion of the housing 11. In addition to the function to display the various display contents, the display part 13 may have a position input function like a touch panel.

The setting part 14 is constituted of an operation key configured to appropriately select and set the various setting contents that are displayed on the display part 13. In FIG. 1, the setting part 14 is arranged at a lower left portion of the front case 11*a*. The setting part 14 is pushed in an appropriate manner along the contents on the setting screen displayed on the display part 13, thereby performing various settings associated with the control.

The power supply part 15 is a power supply unit constituted of a chargeable second battery embedded in the housing 11. The power supply part 15 supplies driving power to the respective parts constituting the transmitter 1 by the control by the control board. In FIG. 2, the power supply part 15 is embedded in a lower portion of the back case 11*b*, as shown with a dashed line. The power supply part 15 is not limited to a second battery, and it may be a battery unit that can be mounted with a primary battery (such as a dry-cell battery).

The antenna 16 is arranged at an upper face of the display part 13 that is provided in a protruded fashion at the upper portion of the housing 11. The antenna 16 is arranged rotatable around its basal portion to enhance directionality of radio wave during the remote-control of the object to be controlled, and also, the angle of the antenna 16 can be adjusted in a multistep fashion such that the antenna 16 can be arranged from a horizontal state to a standing state. Thus, the orientation of the antenna 16 can be adjusted in an appropriate manner based on the distance from the transmitter to the object to be controlled or the control environment or the like before the control.

Figure 3:
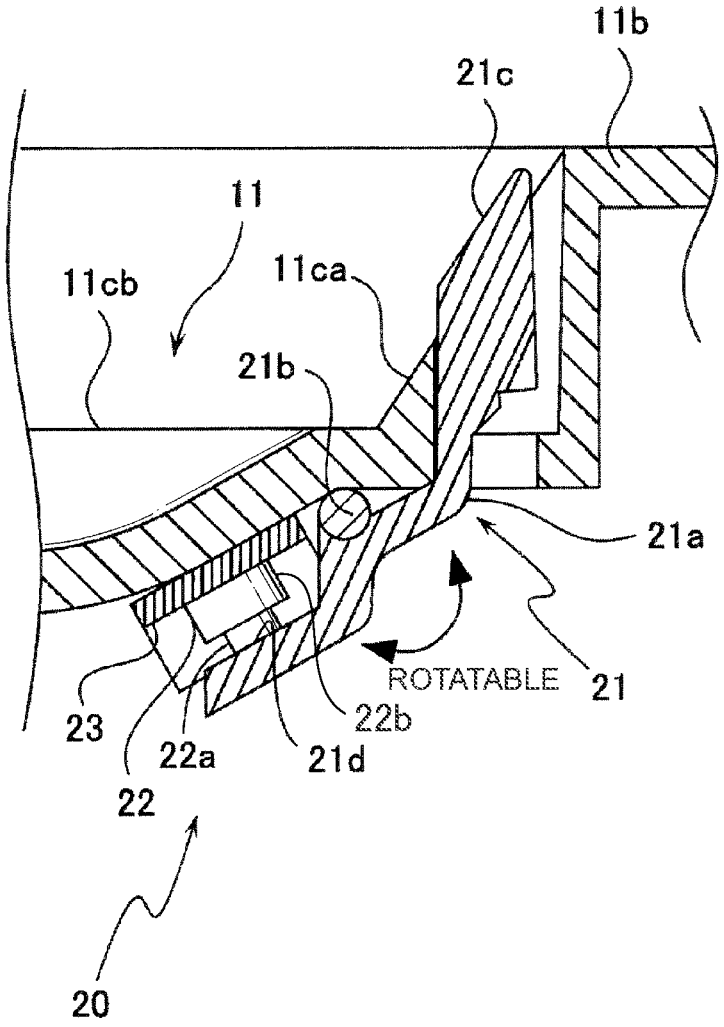
FIG. 3 is a partial enlarged cross sectional view taken along a line A-A shown in FIG. 2.
Figure 4A:
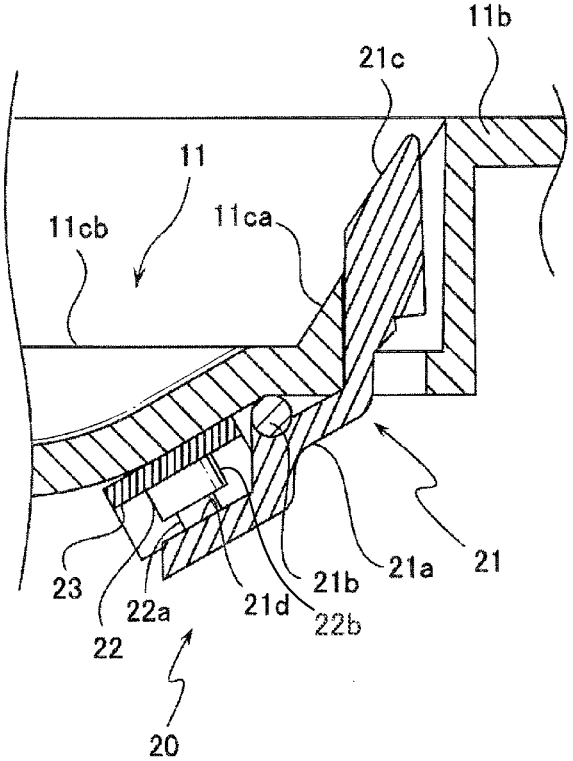
FIGS. 4A and 4B are schematic diagrams each illustrating an operation of a switch mechanism.
Figure 4B:
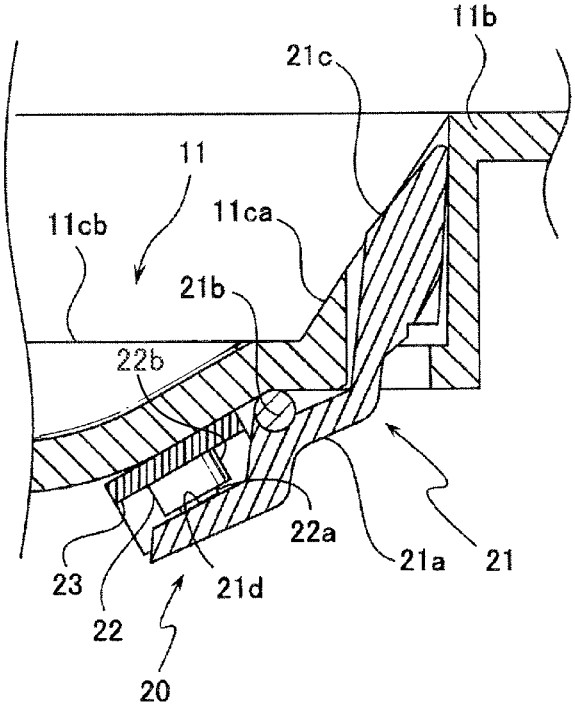
Figure 5:
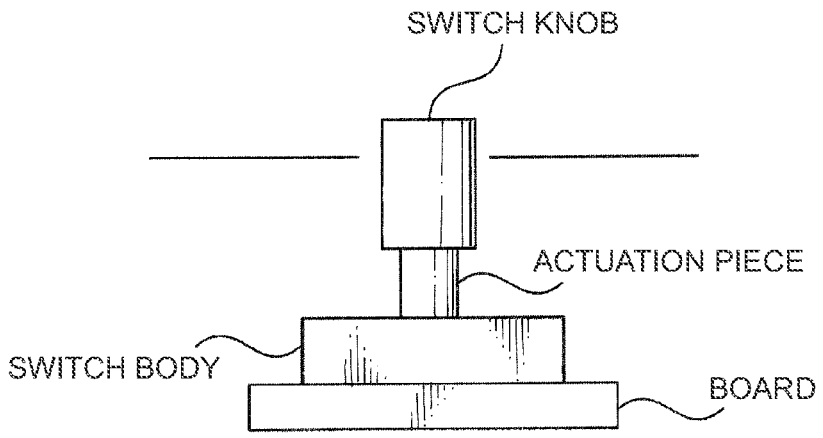
FIG. 5 is a schematic diagram illustrating a switch mechanism in general.
Figure 5:
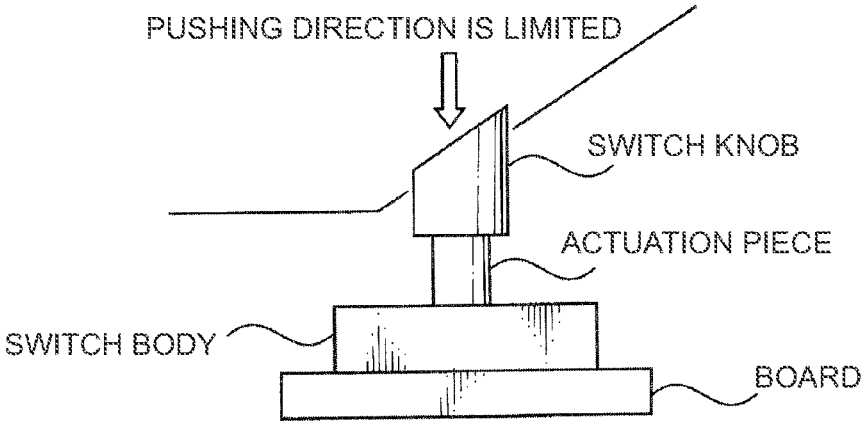

Next, the following will explain the switch mechanism 20 in reference to FIG. 3 and FIGS. 4A, 4B. The switch mechanism 20 according to this embodiment is arranged at a location on the inner peripheral face 11*ca* of the recessed portion 11*c* on which the user's fingertip or finger pulp can abut, such that the switch mechanism 20 can be pushed by the sliding action of the user's finger while allowing the user to hold the grip parts 11*d* during the control of the object to be controlled.

As shown in FIG. 3, the switch mechanism 20 includes a rotatable (swingable) switch knob 21 configured to push an actuation piece 22*a* of a push switch 22 mounted on a switch board 23 as a sub-board attached inside of the back case 11*b*.

In an example shown in FIG. 3, the switch mechanisms 20 are arranged on both sides of the inner peripheral face 11*ca* of the recessed portion 11 (i.e., portions of the inner peripheral face 11*ca* on the right and left sides in FIG. 0.2), respectively, i.e., one switch mechanism 20 on each side of the inner peripheral face 11*ca*. However, number of the switch mechanism 20 provided is not limited to this. That is, the switch mechanism 20 may be arranged one on one side of the inner peripheral face 11*ca*, or plurality of switch mechanisms 20 may be arranged next to each other on one side or on both sides of the inner peripheral face 11*ca*.

The switch knob 21 includes a knob body 21*a* constituted of a long plate material that partially has a curved portion following an inner shape of the back case 11*b*. The knob body 21*a* is arranged rotatable (swingable) around a shaft 21*b*. As shown in FIG. 3, when the switch knob 21 is operated by the user, the knob body 21*a* rotates around the shaft 21*b* in a clockwise direction in the drawing. Further, when the operation of the switch knob 21 ends, the knob body 21*a* rotates around the shaft 21*b* in a counterclockwise direction in the drawing and returns to an original position.

One end of the knob body 21*a* is provided with a push part 21*c* that is exposed from the inner peripheral face 11*ca* and that is pushed down by the user's finger. When the push part 21*c* is pushed by the finger from the inner peripheral part 11*ca* toward inside the back case 11*b*, the pushing force associated with this pushing action makes the knob body 21*a* to rotate around the shaft 21*b*.

The push part 21*c* at least needs to be arranged in a condition that it can be pushed by the user's finger when the user holds the grip parts 11*d*. Thus, although it depends on size of the push part 21*c* or angle of the inner peripheral face 11*ca*, the push part 21*c* does not need to be arranged such that its to-be-pushed face is protruded from the inner peripheral face 11*ca*. That is, the to-be-pushed face of the push part 21*c* may be flush with the inner peripheral face 11*ca*.

Another end of the knob body 21*a* is provided with a transmission part 21*d* that transmits, to the actuation piece 22*a* of the push switch 22, the rotation force (swing force) generated when the push part 21*c* is pushed and the knob body 21*a* is rotated by that pushing force. An abutting face of the transmission part 21*d* and an abutting face of the actuation piece 22*a* are arranged facing to each other and abutted onto each other. Consequently, when the push part 21*c* is pushed by the user's finger and the knob body 21*a* is rotated in a predetermined direction, the transmission part 21*d* moves along the rotation direction of the knob body 21*a*, thereby the actuation piece 22*a* of the push switch 22 is pushed in the substantially perpendicular direction.

For example, the push switch 22 is constituted of a switch like a tact switch that is turned on or turned off by the pushing action (irrespective of momentary type or alternate type). The push switch 22 is mounted on the switch board 23 arranged inside the back case 11*b*, and is constituted of the actuation piece 22*a* and a switch body 22*b*. Thus, when the actuation piece 22*a* is pushed by the transmission part 21*d* of the switch knob 21, an internal contact of the switch body 22*b* is closed, and the function assigned to the push switch 22 is performed.

The switch board 23 is arranged inside of the back case 11*b* and is connected to the control board as the main board via the lead wire. A method for connecting the lead wire may include connecting via a connector or connecting respective ends of the lead wire directly to the respective boards using soldering.

Next, the following will explain the operation of the switch mechanism 20 in reference to FIGS. 4A and 4B.

As shown in FIG. 4A, while holding the transmitter 1, the user may push the push part 21*c* with sliding his/her finger towards the inward side of the inner peripheral face 11*ca* of the recessed portion 11*c*.

When the push part 21*c* is pushed as shown in FIG. 4B, the push part 21*c* is moved inside with respect to the inner peripheral face 11*ca*, and in association with this movement the knob body 21*a* is rotated around the shaft 21*b* in the clockwise direction in the drawing. Further, when the knob body 21*a* is rotated, the transmission part 21*d* is also rotated in the clockwise direction in the drawing. Then, when the transmission part 21*d* is moved and the actuation piece 22*a* is pushed, this movement of the actuation piece 22*a* closes the contact of the push switch 22 and turns on the push switch 22. As a result, the function assigned to the push switch 22 is performed.

When the user' finger is moved apart from the push part 21*c*, the rotation force acting on the transmission part 21*d* is released, thus the actuation piece 22*a* returns to the original position prior to the pushing by a reversal spring embedded inside the switch body 22*b* of the push switch 22. With this returning action of the actuation piece 22*a*, the transmission part 21*d* that is abutting on the actuation piece 22*a* starts to move, and the knob body 21*a* rotates around the shaft 21*b* in the counterclockwise direction in the drawing, and the push part 21*c* returns to the original position prior to the pushing. That is, when the push part 21*c* is not being pushed, the push part 21*c* and the transmission part 21*d* return to the position shown in FIG. 4A.

As described above, the transmitter 1 according to the this embodiment includes the rotatable switch mechanism 20 that is provided at the slanted inner peripheral face 11*ca* of the recessed portion 11*c* formed on the back case 11*b* on the back side of the display part 13.

This switch mechanism 20 includes the knob body 21*a* arranged rotatable around the shaft 21*b*, the push part 21*c* located at one end of the knob body 21*a* and configured to be pushed by the user's finger, and the transmission part 21*d* located at the another end of the knob body 21*a* and configured to transmit the rotation force generated by the pushing of the push part 21*c* to the push switch 22. When the user pushes the push part 21*c* with his/her finger during the control, the knob body 21*a* is rotated around the shaft 21*b*, and this rotation force is transmitted to the actuation piece 22*a* of the push switch 22 via the transmission part 21*d*, thereby pushing the push switch 22.

Consequently, when the push switch 22 mounted on the switch board 23 provided on the back case 11*b* side is pushed, the pushing force by the push part 21*c* pushed by the user's finger rotates the knob body 21*a*, and the actuation piece 22*a* of the push switch 22 is pushed via the transmission part 21*d*. Thus, the user can sense the click feeling associated with the operation.

Furthermore, since the switch knob 21 is arranged rotatable around the shaft 21*b*, the user only needs to slide his/her finger during the control, and the pushing force generated by the sliding action can be transmitted to the knob body 21*a* in a reliable manner and rotates the knob body 21*a*. Consequently, compared to the conventional switch structure, there is more degree of freedom for the direction of application of the pushing force with respect to the push part 21*c*, providing improved usability.

Modified Example

The present invention is not limited to the embodiments described above and may be implemented with an appropriate modification according to use environment, as described below. The following modified examples may be combined arbitrarily and implemented within the scope not departing from the gist of the present invention.

In the above-described embodiment, the switch mechanism 20 is provided with one push part 21*c* and one transmission part 21*d* with respect to the knob body 21*a*. But the present invention is not limited to this.

For example, the push parts 21*c* may be provided on both ends of the knob body 21*a*, and each push part 21*c* may be provided with the transmission part 21*d* arranged on back side of each push part 21*c*, and the knob body 21*a* may be provided near a center and arranged rotatable around the shaft 21*b*. The switch mechanism 20 having such configuration has a function similar to that of a so-called seesaw switch. Thus, by providing the push switches 22 each facing each of the transmission parts 21*d*, one of the two push switches 22 assigned with the respective functions can be pushed alternatively.

Furthermore, addition of a function that allows the shaft 21*b* to move in the direction of pushing by the finger will allow pushing near the center of the knob body 21*a* to simultaneously push two push switches 22, in addition to alternatively selecting one of the push switches 22. Thus, it is possible to assign three kinds of functions corresponding to the push switch 22 to be pushed.

LIST OF REFERENCE SIGNS

1 radio control transmitter
11 housing (11*a* front case; 11*b* back case; 11*c* recessed portion;
11*ca* inner peripheral face of recessed portion; 11*cb* bottom face of recessed portion; 11*d* grip part)
12 operation part (12*a*, 12*b* sticks; 12*c* setting changing operation members; 12*d* power supply switch; 12*e* push switch)
13 display part
14 setting part
15 power supply part
16 antenna
20 switch mechanism
21 switch knob (21*a* knob body; 21*b* shaft; 21*c* push part; 21*d* transmission part)
22 push switch (22*a* actuation piece)
23 switch board as sub board

What is claimed is:

1. A radio control transmitter configured to control an object to be controlled, comprising:
a housing; and
a switch mechanism, wherein
the housing includes a recessed portion formed on a back side of the housing, the recessed portion including a bottom face and an inner peripheral face, the inner peripheral face being slanted so as to gradually extend outward from the bottom face,
the switch mechanism is provided to the inner peripheral face of the recessed portion,
the switch mechanism includes a switch knob and a push switch,
the switch knob includes
a knob body supported inside the housing in a manner rotatable around a shaft,
a push part provided on a first end of the knob body so as to be exposed from the inner peripheral face, and
a transmission part provided on a second end of the knob body and configured to transmit rotation force of the knob body rotated by pushing force generated by pushing the push part, and
the push switch is mounted on a switch board arranged on the back side of the housing and is configured to be operated by the rotation force that is generated by rotation action of the switch knob and that is transmitted to the push switch via the transmission part.

2. The radio control transmitter according to claim 1, further comprising a display part provided at a substantially central portion of a front side of the housing, with an upper end of the display part being protruded from an upper portion of the housing,
wherein the recessed portion is formed on the back side of the housing at a location opposed to the display part.

* * * * *